US009178327B2

(12) United States Patent
Cutsforth

(10) Patent No.: US 9,178,327 B2
(45) Date of Patent: Nov. 3, 2015

(54) BRUSH LEAD GUIDE FOR A BRUSH HOLDER ASSEMBLY

(75) Inventor: Robert S. Cutsforth, Bellingham, WA (US)

(73) Assignee: CUTSFORTH, INC., Cohasset, MN (US)

( * ) Notice: Subject to any disclaimer, the term of this patent is extended or adjusted under 35 U.S.C. 154(b) by 900 days.

(21) Appl. No.: 13/419,937

(22) Filed: Mar. 14, 2012

(65) Prior Publication Data

US 2013/0244450 A1 Sep. 19, 2013

(51) Int. Cl.
*H01R 39/36* (2006.01)
*H01R 39/41* (2006.01)

(52) U.S. Cl.
CPC ..... *H01R 39/36* (2013.01); *H01R 39/41* (2013.01)

(58) Field of Classification Search
CPC ..... H01R 39/36
See application file for complete search history.

(56) References Cited

U.S. PATENT DOCUMENTS

| | | | | |
|---|---|---|---|---|
| 1,307,028 | A * | 6/1919 | Sweet | 310/239 |
| 2,935,632 | A * | 5/1960 | Schmitz, Jr. | 310/249 |
| 3,534,206 | A * | 10/1970 | Carey | 310/247 |
| 3,641,379 | A | 2/1972 | Vick | |
| 5,387,831 | A * | 2/1995 | Yang | 310/242 |
| 5,739,619 | A * | 4/1998 | Thornley | 310/248 |
| 7,034,430 | B2 | 4/2006 | Custforth et al. | |
| 7,122,935 | B2 | 10/2006 | Custforth et al. | |
| 7,141,906 | B2 | 11/2006 | Custforth et al. | |
| 7,218,028 | B2 * | 5/2007 | Annis et al. | 310/240 |
| 7,417,354 | B2 | 8/2008 | Cutsforth et al. | |
| 7,545,072 | B2 | 6/2009 | Cutsforth | |
| 7,564,160 | B2 | 7/2009 | Cutsforth et al. | |
| 7,705,744 | B2 | 4/2010 | Cutsforth | |
| 7,768,174 | B2 | 8/2010 | Cutsforth et al. | |
| 7,816,834 | B2 | 10/2010 | Cutsforth | |
| 7,880,362 | B2 | 2/2011 | Cutsforth et al. | |
| 7,880,363 | B2 | 2/2011 | Cutsforth et al. | |
| 7,916,038 | B2 | 3/2011 | Cutsforth | |
| 7,960,892 | B2 | 6/2011 | Cutsforth | |
| 7,990,018 | B2 | 8/2011 | Cutsforth et al. | |
| 7,994,683 | B2 | 8/2011 | Cutsforth et al. | |
| 8,134,472 | B2 | 3/2012 | Cutsforth | |
| 8,179,014 | B2 | 5/2012 | Cutsforth et al. | |
| 2001/0043022 | A1 | 11/2001 | Narushima et al. | |
| 2006/0021775 | A1 | 2/2006 | Duesselberg et al. | |
| 2008/0291273 | A1 | 11/2008 | Cutsforth et al. | |
| 2009/0096315 | A1 | 4/2009 | Mantle | |

FOREIGN PATENT DOCUMENTS

| | | | |
|---|---|---|---|
| DE | 102005062073 | A1 | 7/2007 |
| WO | WO03052902 | A1 | 6/2003 |

* cited by examiner

*Primary Examiner* — Dang Le
(74) *Attorney, Agent, or Firm* — Seager, Tufte & Wickhem LLP

(57) ABSTRACT

A brush lead guide for a brush holder assembly configured to retain the leads extending from a brush in a desired position/orientation to ensure the leads do not interfere with movement of the brush within the brush holder. In some instances, the lead guide includes a first guide rail including a channel for receiving a first lead of the brush and a second guide rail including a channel for receiving a second lead from the brush. The lead guide maintains the leads in a position such that the leads are held within the width of the opening of the brush holder to ensure the leads do not interfere with movement of the brush within the brush holder during use of the brush holder assembly.

26 Claims, 10 Drawing Sheets

BRUSH LEAD GUIDE FOR A BRUSH HOLDER ASSEMBLY

TECHNICAL FIELD

The disclosure is directed to a guide configured for maintaining the leads extending from a brush of a brush holder assembly in a desired position/orientation. More particularly, the disclosure is directed to a brush lead guide for a brush holder assembly configured to retain the leads extending from a brush in a desired position/orientation to ensure the leads do not interfere with movement of the brush within the brush holder.

BACKGROUND

A purpose of a brush in an electrical device is to pass electrical current from a stationary contact to a moving contact surface, or vice versa. Brushes and brush holders may be used in electrical devices such as electrical generators, electrical motors, and/or slip ring assemblies, or sliding connection applications, for example, slip ring assemblies on a rotating machine such as a rotating crane or a linear sliding connection on a monorail. Brushes in many electrical devices are blocks or other structures made of conductive material, such as graphite, carbon graphite, electrographite, metal graphite, or the like, that are adapted for contact with a conductive surface or surfaces to pass electrical current. Electrically conductive leads or shunts extend from the brush to provide an electrical pathway to and/or from the brush from another conductive member.

In some designs, a brush box type brush holder, or other type of brush holder, may be used to support the brush during operation. The brush and brush box may be designed such that the brush can slide within the brush box to provide for continuing contact between the brush and the conductive surface contacted by the brush. Over time, the brush will be reduced in size, or get shorter (i.e., diminish in longitudinal length), for example, as the wear surface of the brush in frictional contact with the conductive surface wears down. Accordingly, the brush is intended to move within the brush holder. If left unconstrained, the leads extending from the brush may interfere with free movement in the brush holder, as the brush wears down. Accordingly, it is desirable to provide a structure to retain the leads extending from the brush in a desired position/orientation to ensure the leads do not interfere with movement of the brush within the brush holder.

SUMMARY

The disclosure is directed to alternative designs, materials and methods of manufacturing electrical brush lead guide structures and assemblies, and uses thereof.

Accordingly, one illustrative embodiment is a lead guide for maintaining the leads extending from a brush of a brush holder assembly in a desired position. The lead guide includes a bracket comprising a first guide rail, a second guide rail, and a cross member extending between the first guide rail and the second guide rail. The first guide rail includes a channel for receiving a first lead of the brush and the second guide rail includes a channel for receiving a second lead from the brush. The bracket is configured to space the first lead away from the second lead to permit a spring of the brush holder assembly to be positioned therebetween.

Another illustrative embodiment is a brush holder assembly for an electrical device. The brush holder assembly includes a brush holder, a brush, and a lead guide. The brush is positionable in the brush holder. The brush includes at least one lead extending from the brush. The lead guide is coupled to the at least one lead and configured to travel with the brush relative to the brush holder as the brush diminishes in length during use. The lead guide is configured to prevent the at least one lead from contacting the brush holder and restricting free movement of the brush in the brush holder. In some instances, the lead guide includes a first guide rail extending along a base portion of a first lead and a second guide rail extending along a base portion of a second lead, with the lead guide positioned between the leads. In some instances, the brush holder assembly includes a spring configured to exert a force against the brush in the brush holder. The spring is positionable between the first guide rail of the lead guide and the second guide rail of the lead guide.

The above summary of some example embodiments is not intended to describe each disclosed embodiment or every implementation of the aspects of the disclosure.

BRIEF DESCRIPTION OF THE DRAWINGS

The aspects of the disclosure may be more completely understood in consideration of the following detailed description of various embodiments in connection with the accompanying drawings, in which.

Figure 1:
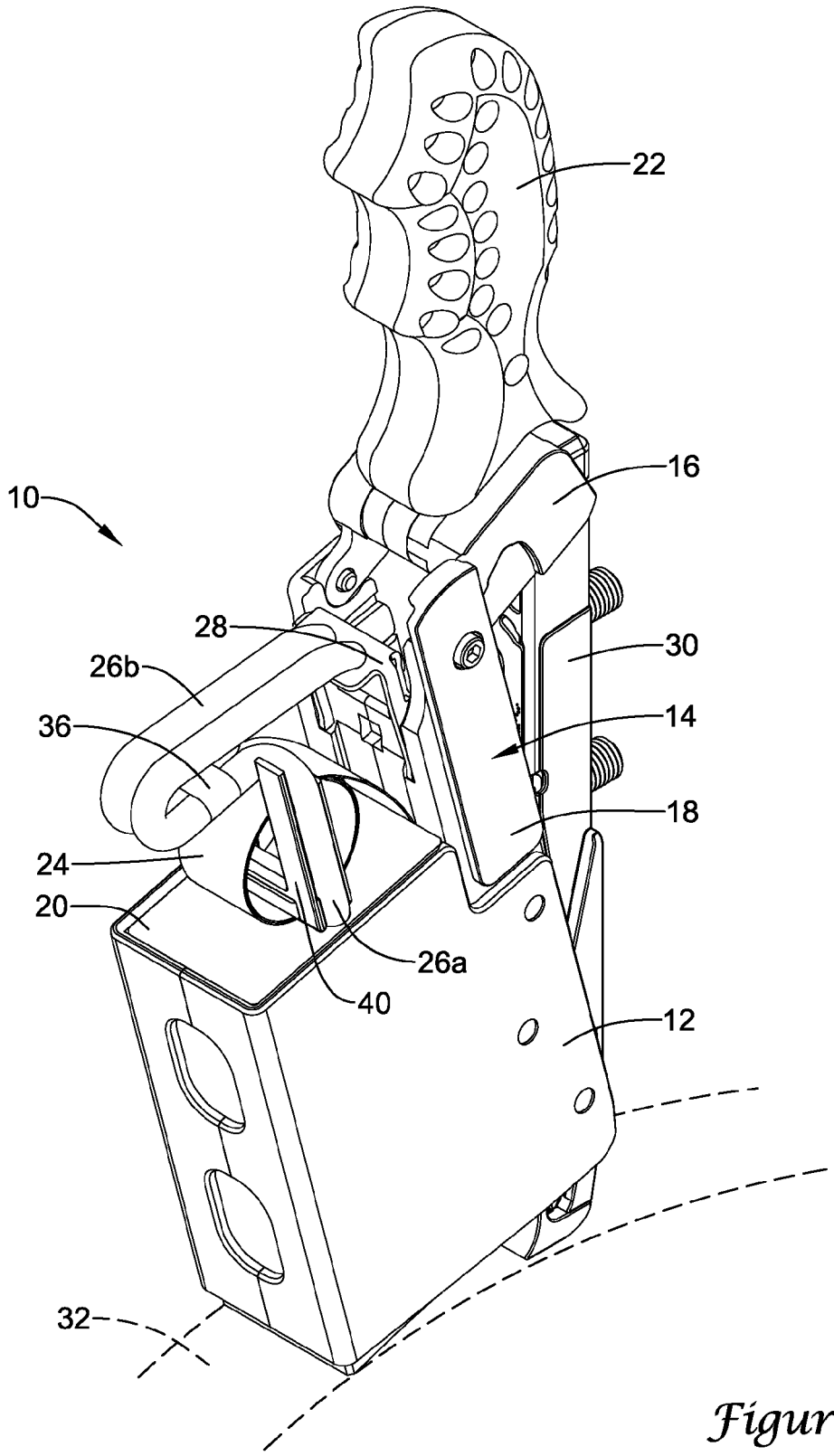
FIG. 1 is a perspective view of an exemplary brush holder assembly for an electrical device in a disengaged position.

While the aspects of the disclosure are amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the disclosure. The illustrative embodiments depicted are intended only as exemplary. Selected features of any illustrative embodiment may be incorporated into an additional embodiment unless clearly stated to the contrary.

A brush holder assembly 10, for example as shown in FIG. 1, may include a brush holder 12, such as a brush box, surrounding a brush 20 on several sides and including a plurality of guiding surfaces for guiding linear or longitudinal movement of the brush 20. In some embodiments, the brush holder 12 may not take on the form of a box, but may include one or a plurality of guiding surfaces, such as channels, posts or columns, abutting and/or encompassing one or more sides of the brush 20 and/or extending into or through the brush 20, or a portion thereof, for guiding linear or longitudinal movement of the brush 20.

The brush holder 12 may be secured to a mounting beam 14 configured and adapted to be mounted to another structure, such as a mounting block 30. The brush holder assembly 10 is configured to place the brush 20 in contact with a conductive surface 32, such as a rotating surface of a collector ring, a slip ring, or a commutator, and conduct current therefrom. The brush 20 may extend from the lower edge of the brush holder 12 such that a wear surface 31 of the brush 20 engages the conductive surface 32. The mounting beam 14 may include an over-center engagement mechanism, a slotted or channeled engagement mechanism for sliding engagement, or other mechanism for easily engaging and disengaging the brush 20 from a conductive surface 32.

In some embodiments, the brush holder assembly 10 may substantially resemble a brush holder assembly as described in U.S. Pat. No. 7,034,430, entitled "Brush Holder Apparatus, Brush Assembly, and Method", which is herein incorporated by reference in its entirety. In other embodiments, the brush holder assembly may include a brush holder rigidly mounted to another structure holding the brush holder stationary, or mounted to another structure in any desired arrangement. For example, in some embodiments the brush holder may be bolted or welded to a stationary structure. Some such brush holders are disclosed in U.S. Pat. Nos. 6,731,042; 5,753,992; 5,621,262; 5,463,264; 5,397,952; and 5,256,925; which are incorporated herein by reference.

Figure 2:
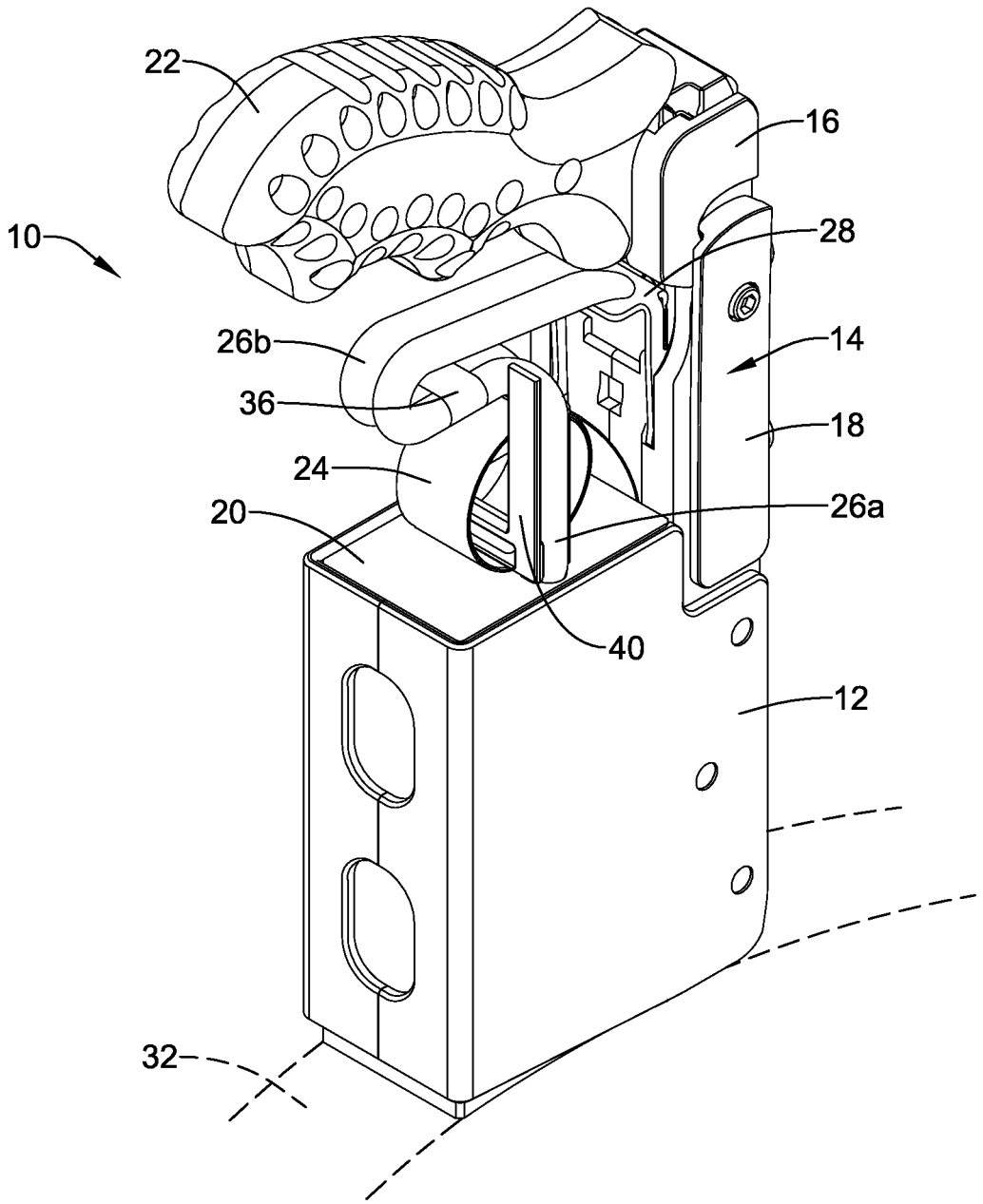
FIG. 2 is a perspective view of the exemplary brush holder assembly of FIG. 1 in an engaged position.

As shown in FIG. 1, the mounting beam 14 may include an upper beam member 16 and a lower beam member 18 hingedly or pivotably coupled to one another. As shown in FIG. 1, when the upper beam member 16 is tilted from the lower beam member 18 (e.g., the longitudinal axis of the upper beam member 16 is oblique to the longitudinal axis of the lower beam member 18), the brush holder 12 may be considered to be in a disengaged, or unlocked, position such that the brush 20 may be non-contiguous with, spaced from, or otherwise not in direct electrical contact with the conductive surface 32. As shown in FIG. 2, when the upper beam member 16 and the lower beam member 18 are aligned with one another (e.g., the longitudinal axis of the upper beam member 16 is parallel with the longitudinal axis of the lower beam member 18), the brush holder 12 may be considered to be in an engaged, or locked, position such that the brush 20 may be contiguous with or in contact with the conductive surface 32.

The mounting beam 14 may be removably coupled to the mounting block 30 during operation. In some embodiments, the mounting beam 14 may slidably engage with, interlock with, or otherwise be removably coupled to the mounting block 30. The mounting block 30 may be coupled to, secured to, or otherwise extend from another structure which maintains the mounting block 30 stationary with respect to the conductive surface 32, for example.

In some embodiments, a handle 22 may be attached to the brush holder 12 to facilitate engagement and disengagement of the brush 20 from the conductive surface 32. For example, the handle 22 may be attached to the upper beam member 16 such that movement of the handle 22 actuates (e.g., pivots, slides, releases) the upper beam member 16 relative to the lower beam member 18 between the disengaged position (FIG. 1) and engaged position (FIG. 2). The handle 22 may be a removable handle or the handle 22 may be permanently attached to the upper beam member 16 or another portion of the brush holder 12.

Also illustrated in FIG. 1 is a brush spring 24, such as a constant force spring, which provides tension to the brush 20 to bias the brush 20 toward and in contact with the conductive surface 32. The spring 24 may be attached to a portion of the brush holder 12 or the mounting beam 14 of the brush holder assembly 10, for example. In some embodiments, the spring 24 may extend along one side surface of the brush 20 between the brush 20 and the mounting beam 14 of the brush holder assembly 10.

The brush 20 may include one or more electrical leads (e.g., shunts), such as braided copper cables, for conducting electricity to and/or from the electrically conductive surface 32 through the brush 20. For example, a first electrical lead **26*a* and a second electrical lead 26*b* may extend from the brush 20 to an electrically conductive terminal 28 coupled to a component of the brush holder assembly 10, such as the mounting beam 14. The ends of the leads 26*a*, 26*b* may be soldered, brazed, crimped, clamped or otherwise removably or permanently secured to the terminal 28**.

Figure 3:
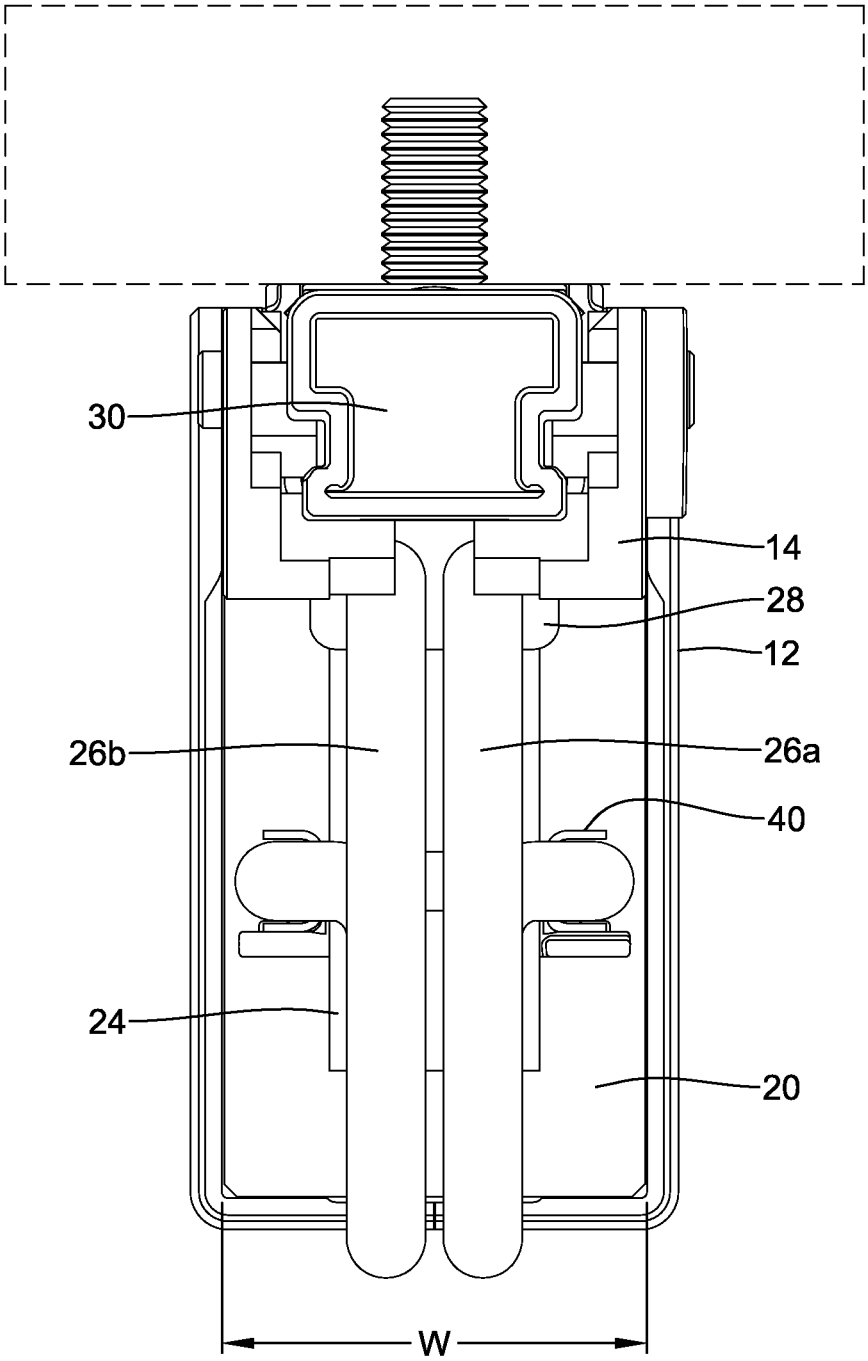
FIG. 3 is a top view of the brush holder assembly of FIG. 1.

The brush holder assembly 10 may also include a brush lead guide 40 configured to retain the leads **26*a*, 26*b* extending from the brush 20 in a desired position/orientation to ensure the leads 26*a*, 26*b* do not interfere with movement of the brush 20 within the brush holder 12. For example, the guide 40 may maintain the first lead 26*a* and the second lead 26*b* in a spaced apart arrangement such that the spring 24 may be positioned between the first lead 26*a* and the second lead 26*b*. Furthermore, as shown in FIG. 3, the guide 40, which may move with the brush 20 relative to the brush holder 12, may maintain the first lead 26*a* and the second lead 26*b* in a position such that the leads 26*a*, 26*b* are held within the width W of the opening of the brush holder 12 (i.e. the distance between the outer edge of the first lead 26*a* and the outer edge of the second lead 26*b* is less than the width W of the opening of the brush holder 12) to ensure leads 26*a*, 26*b* do not interfere with movement of the brush 20 within the opening of the brush holder 12 during use of the brush holder assembly 10. For example, the guide 40 may prevent the leads 26*a*, 26*b* from catching on or dragging/rubbing against the walls of the brush holder 12 as the brush 20 moves in the brush holder 12**.

Figure 4A:
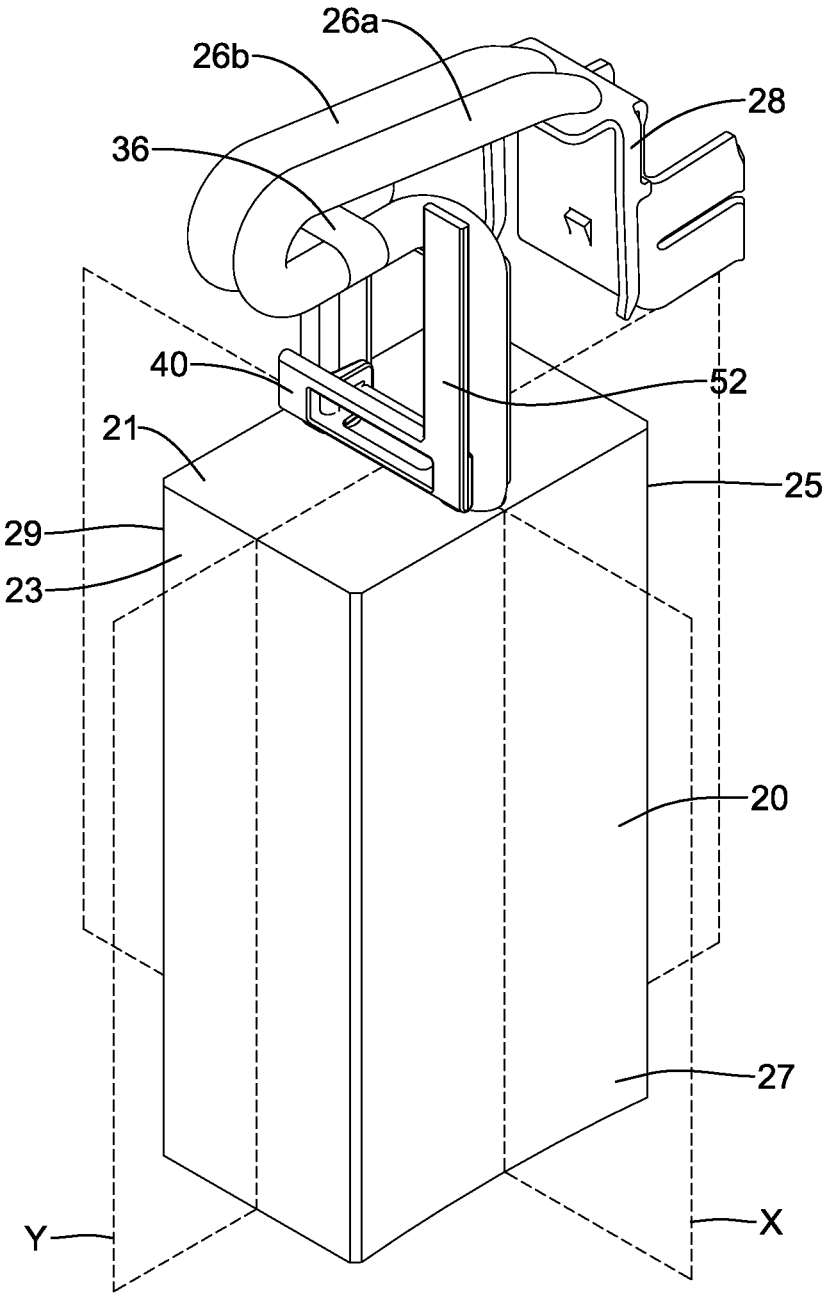
FIGS. 4A and 4B are perspective views of components of a replaceable brush of the brush holder assembly of FIG. 1.
Figure 4B:
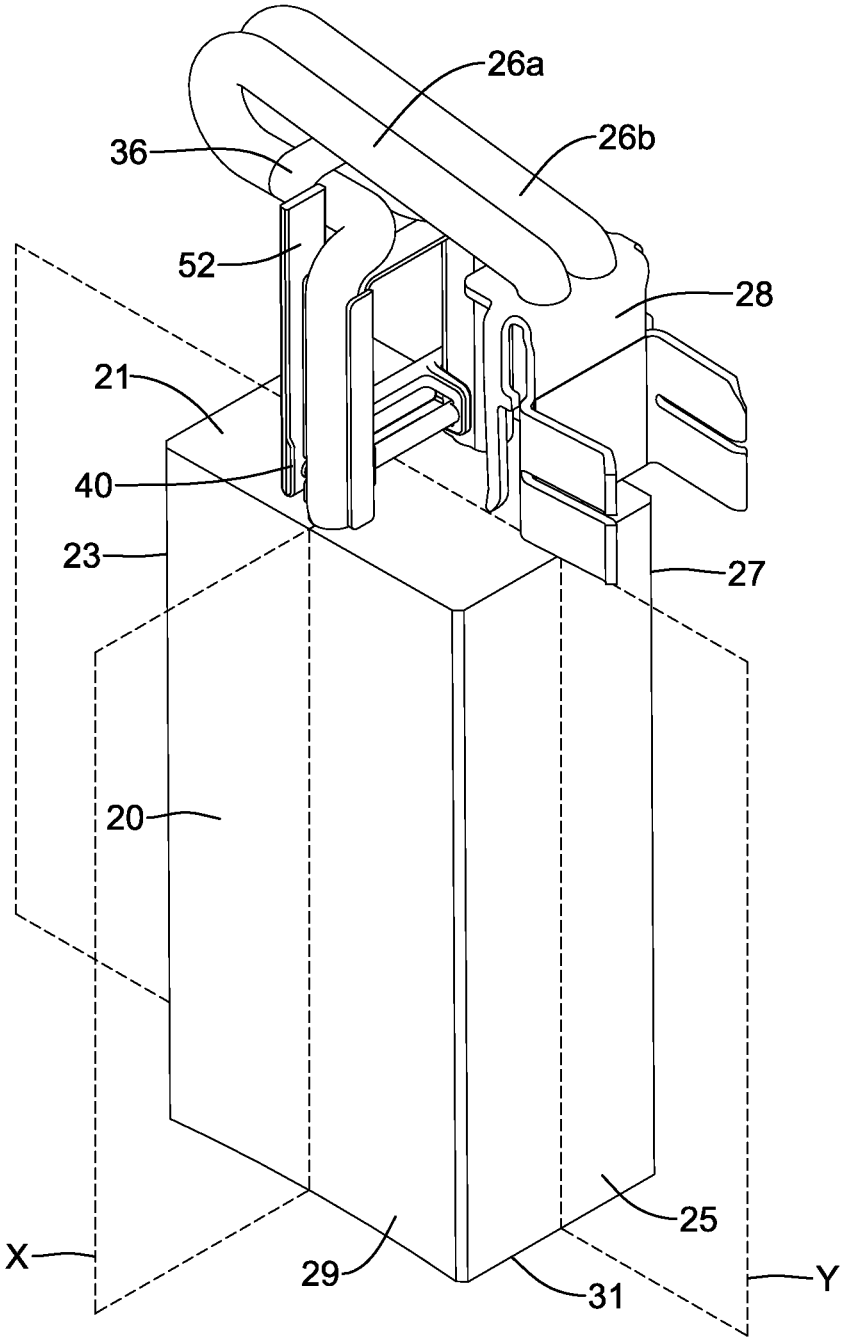

FIGS. 4A and 4B further illustrate the arrangement of the guide 40 between portions of the leads **26*a*, 26*b*. As shown in FIGS. 4A and 4B, the leads 26***a*, 26*b* may extend from an upper surface 21 of the brush 20 opposite the lower wear surface 31 at spaced apart locations. The leads 26*a*, 26*b* may be arranged to extend from the upper surface 21 along a midplane X of the brush equally spaced between the front surface 23 of the brush 20 and the rear surface 25 of the brush 20. Furthermore, the leads 26*a*, 26*b* may be arranged equidistantly from the midplane Y of the brush 20 between the first side surface 27 and the second side surface 29 of the brush 20. In other words, each of the first lead 26*a* and the second lead 26*b* may be positioned the same distance from the midplane Y on opposite sides of the midplane Y of the brush 20. With such an arrangement in which the leads 26*a*, 26*b* may be spaced apart a desired distance and centrally located extending from the upper surface 21 of the brush 20, various sizes of brushes 20 may be made (i.e., brushes with different lengths between the front and rear surfaces 23, 25 and/or different widths between the side surfaces 27, 29) while the spacing between the leads 26*a*, 26*b* may be constant such that a single sized lead guide 40 may be used regardless of the dimensions of the brush 20.

The lead guide 40 may be positioned between the leads 26*a*, 26*b* to maintain a proper distance between a base portion of the leads 26*a*, 26*b* to accommodate the spring 24 therebetween. The lead guide 40 may be positioned between the leads 26*a*, 26*b* and the spring 24 to prevent direct contact between the leads 26*a*, 26*b* and the spring 24, and thus prevent the leads 26*a*, 26*b* from being cut, worn, scraped, abraded or otherwise damaged by the spring 24.

The portion of the leads 26*a*, 26*b* extending from the guide 40 to or toward the terminal 28 may converge and be secured together with a fastener 36, such as a clip, tape, ring, or other mechanism to hold the leads 26*a*, 26*b* together. Additional fasteners 36 may be used if desired along portions of the length of the leads 26*a*, 26*b* to secure the leads 26*a*, 26*b* in a desired arrangement. Accordingly, the fastener 36 may prevent the leads 26*a*, 26*b* from spreading apart, while the guide 40 may prevent the leads 26*a*, 26*b* from converging together, thus holding the leads 26*a*, 26*b* in a desired position. The guide 40 may include first and second channels 46 for receiving the leads 26*a*, 26*b* therein to maintain the leads 26*a*, 26*b* generally parallel and spaced apart as the leads 26*a*, 26*b* extend from the upper surface 21 of the brush 20. In the illustrated embodiment, the lead guide 40 may permit the leads 26*a*, 26*b* to flex at the upper surface 21 of the brush 20 toward and/or away from the front and rear surfaces 23, 25 during the life of the brush 20, while preventing the leads 26*a*, 26*b* from flexing toward and away from the side surfaces 27, 29 of the brush 20. Thus, the lead guide 40 may be configured to permit a degree of movement of the leads 26*a*, 26*b* at the interface with the upper surface 21 of the brush 20 as the brush 20 is moved through the brush holder 12 as the brush 20 is worn.

Figure 5A:
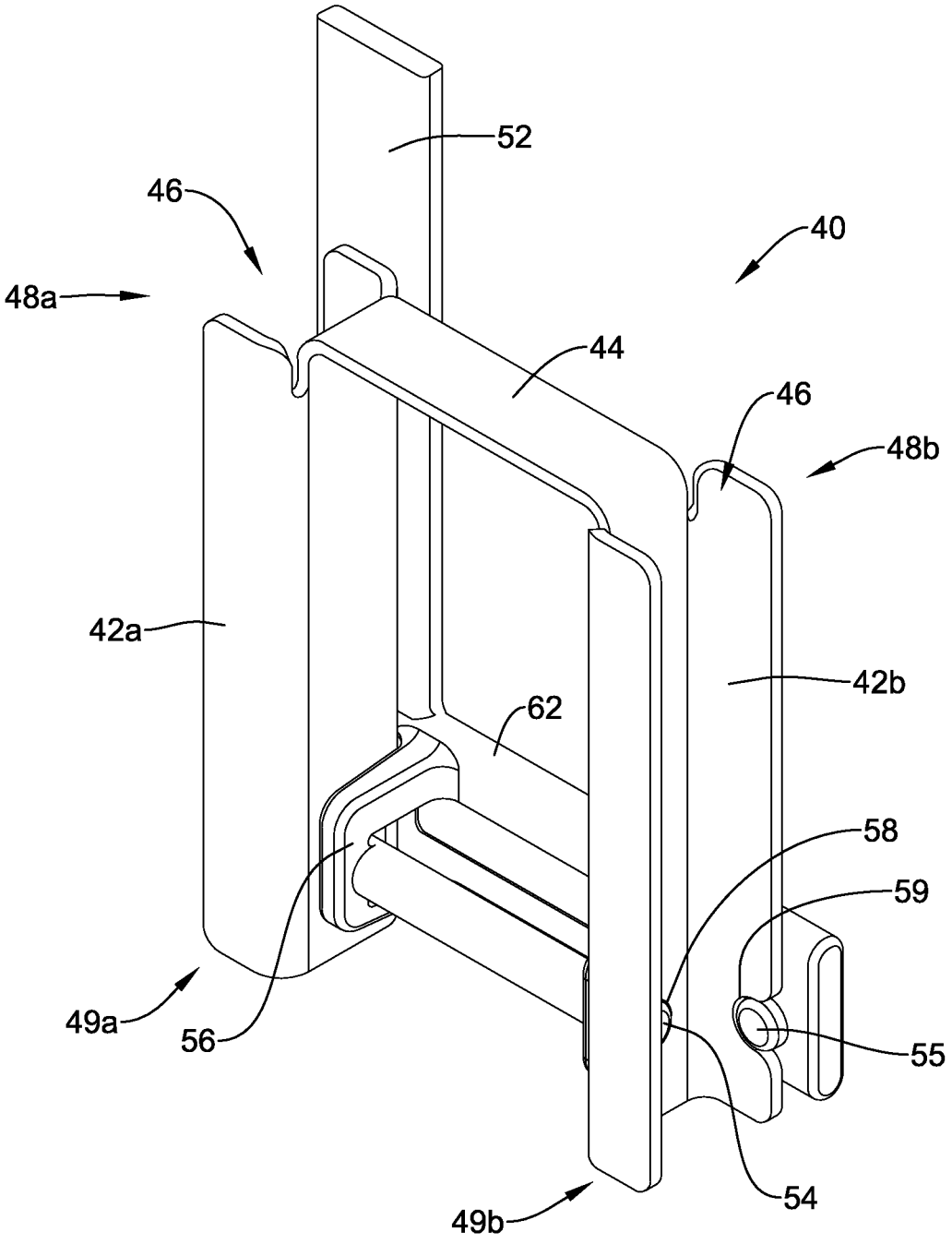
FIGS. 5A and 5B are perspective views of an exemplary lead guide for maintaining the leads extending from a brush in a desired position/orientation.
Figure 5B:
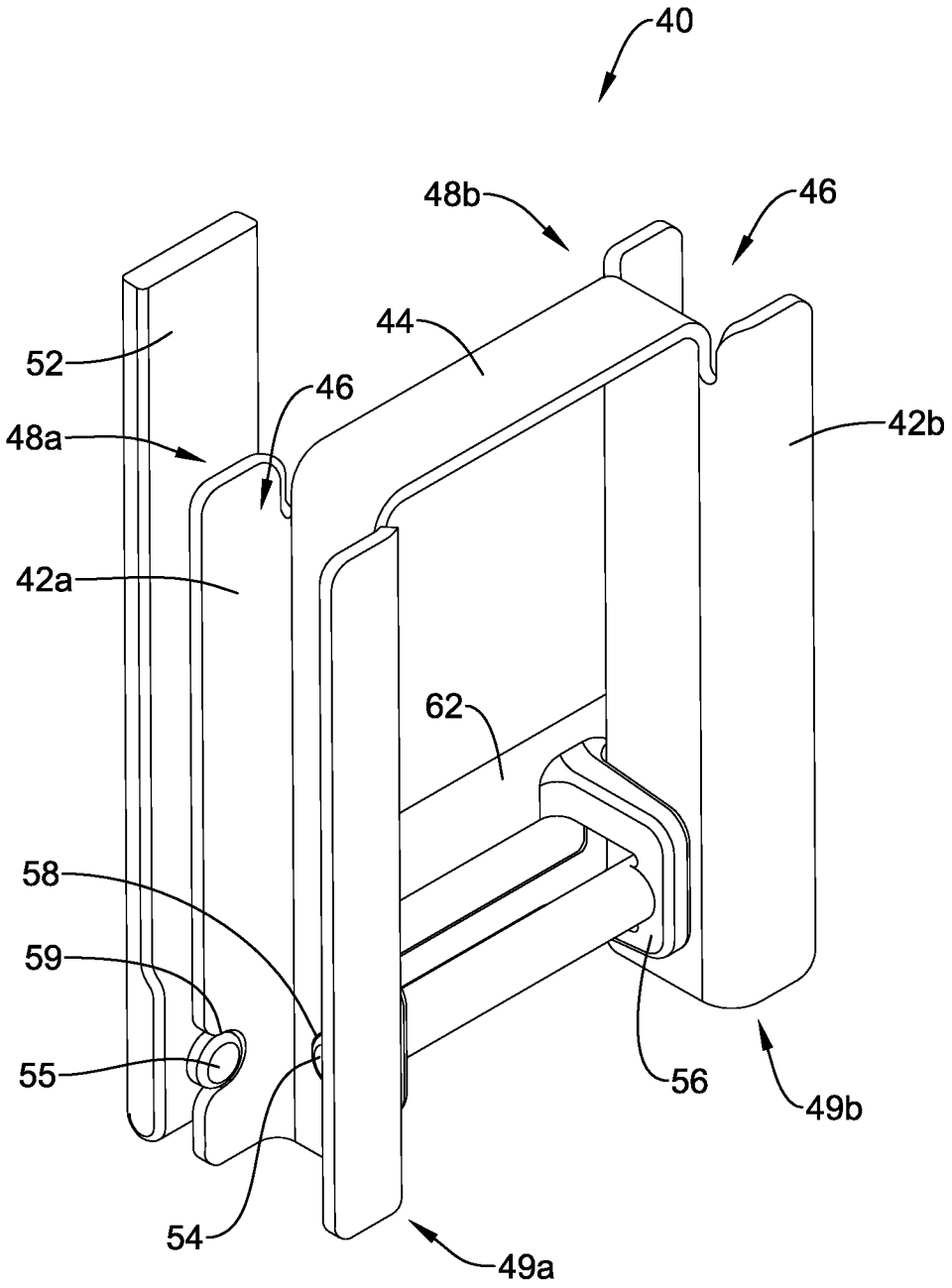
Figure 6A:
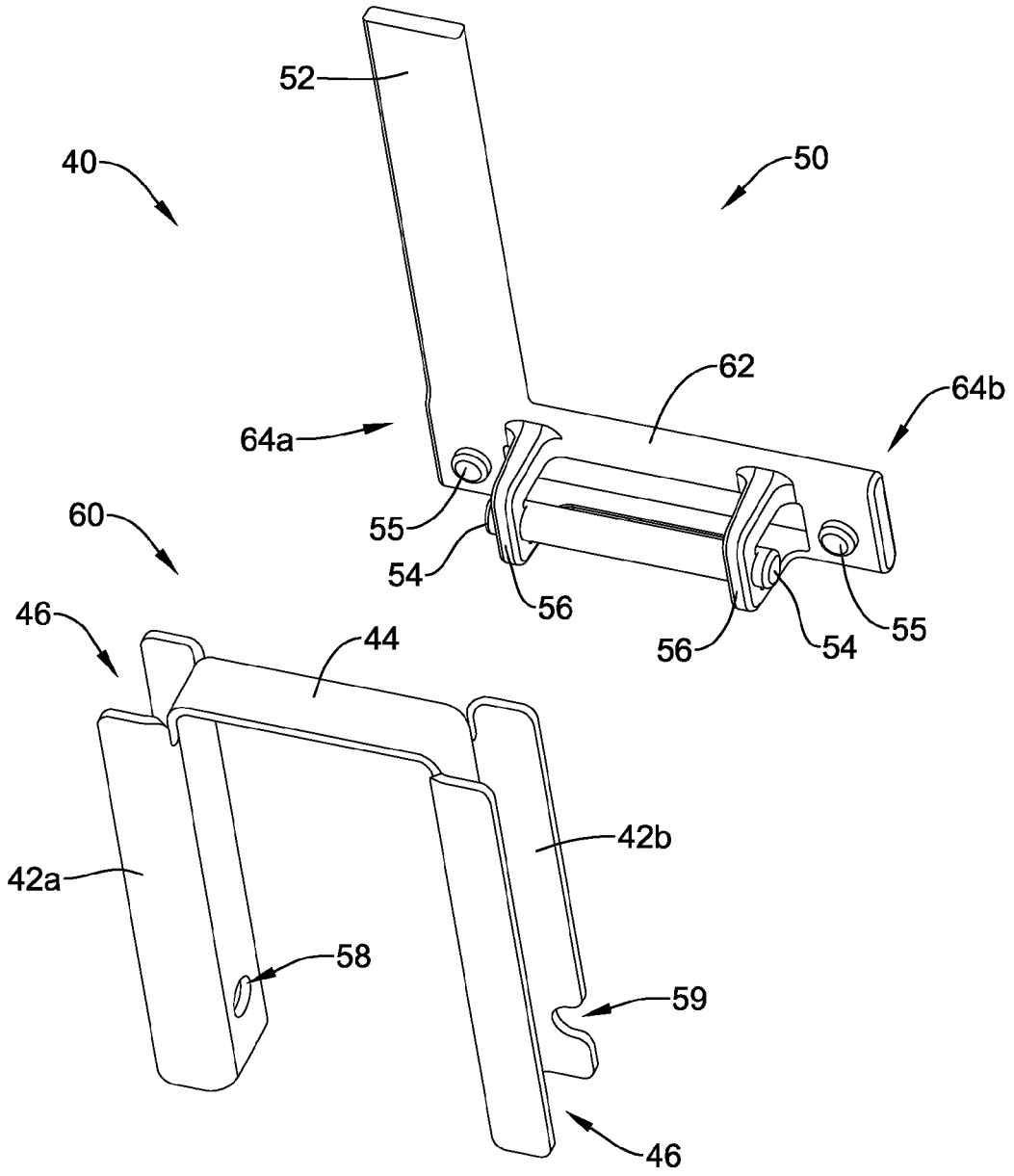
FIGS. 6A and 6B are exploded perspective views of the exemplary lead guide of FIGS. 5A and 5B.
Figure 6B:
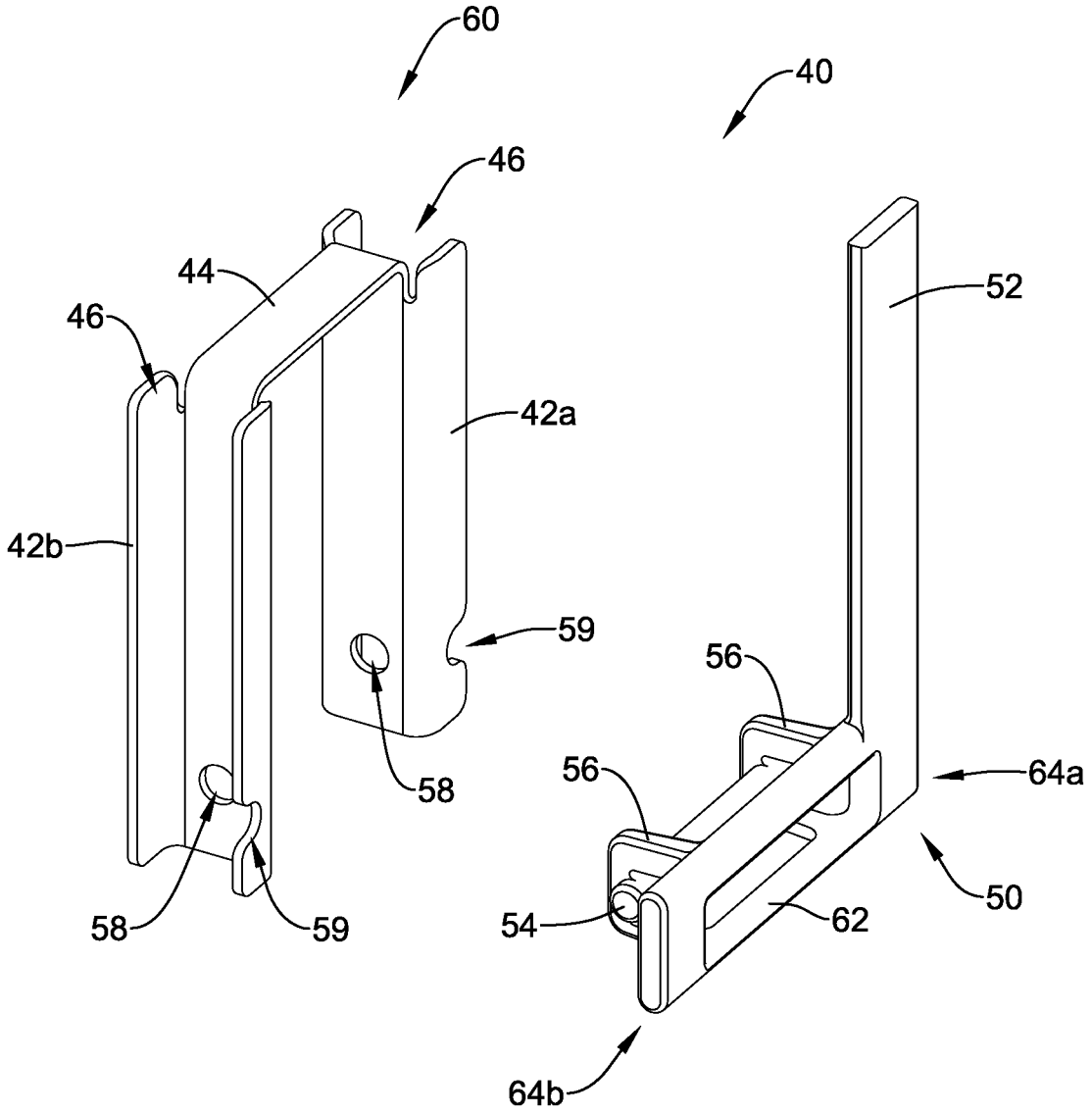

Turning to FIGS. 5A and 5B, as well as the exploded views of FIGS. 6A and 6B, features of the guide 40 are further illustrated. The guide 40 may include a first member, such as a bracket 60, and a second member, such as a brace 50, which may be coupled together. The bracket 60 and the brace 50 may be formed of any desired material, including resilient metal materials and/or polymeric materials. In some instances, the bracket 60 may be formed from a resilient metal material such as stainless steel or copper, while the brace 50 may be formed of a suitable polymeric material.

The bracket 60 may include a first guide rail 42*a*, a second guide rail 42*b* and a cross member 44 extending between the first guide rail 42*a* and the second guide rail 42*b*, such as from an end of the first guide rail 42*a* to an end of the second guide rail 42*b*. In some embodiments, the cross member 44 may extend between the first end 48*a* of the first guide rail 42*a* and the first end 48*b* of the second guide rail 42*b*. In some instances, the bracket 60 may be formed as a unitary member including the first guide rail 42*a*, the second guide rail 42*b* and the cross member 44, while in other embodiments the bracket 60 may be formed of multiple members secured together. The first guide rail 42*a*, which in some instances may be considered a first leg of the bracket 60, may be arranged generally parallel to the second guide rail 42*b*, which in some instances may be considered a second leg of the bracket 60, or at any desired angle relative to the second guide rail 42*b*.

The first guide rail 42*a* may define a channel 46 for receiving a portion of the first lead 26*a* therein and the second guide rail 42*b* may define a channel 46 for receiving a portion of the second lead 26*b* therein. In some instances, the channels 46 of the first and second guide rails 26*a*, 26*b* may open out in opposite directions. The channel 46 of the first guide rail 42*a* may extend from the first end 48*a* to the second end 49*a* of the first guide rail 42*a*, and the channel 46 of the second guide rail 42*b* may extend from the first end 48*b* to the second end 49*b* of the second guide rail 42*b*.

The brace 50 may be configured to be removably attached to the bracket 60 to prevent relative movement between the first and second guide rails 42*a*, 42*b*. For example, the brace 50 may be configured to stabilize the first guide rail 42*a* relative to the second guide rail 42*b*, such as to prevent movement of the first and second guide rails 42*a*, 42*b* toward and/or away from one another.

The brace 50 may include a cross member 62 extending between the first guide rail 42*a* and the second guide rail 42*b*, such as from an end of the first guide rail 42*a* to an end of the second guide rail 42*b*. In some embodiments, the cross member 62 may extend between the second end 49*a* of the first guide rail 42*a* and the second end 49*b* of the second guide rail 42*b*.

The brace 50 may include an engagement interface configured to mate with and engage an engagement interface of the bracket 60 to removably couple the brace 50 to the bracket 60. For example, the brace 50 may include a first end 64*a* having one or more posts 54, 55 configured to interlock with one or more openings 58, 59 in the first guide rail 42*a*, and the brace 50 may include a second end 64*b* having one or more posts 54, 55 configured to interlock with one or more openings 58, 59 in the second guide rail 42*b*. In some instances, the openings 58 may be through holes extending through the base portion of the guide rails 42*a*, 42*b*, and/or the openings 59 may be notches formed on an edge of the side portions of the guide rails 42*a*, 42*b*. It is noted that in other embodiments, the bracket 60 may include posts 54, 55 and the brace 50 may including openings 58, 59 for receiving the posts 54, 55, if desired. Other interconnecting structures are also contemplated for removably coupling the brace 50 to the bracket 60 of the lead guide 40.

Figure 7:
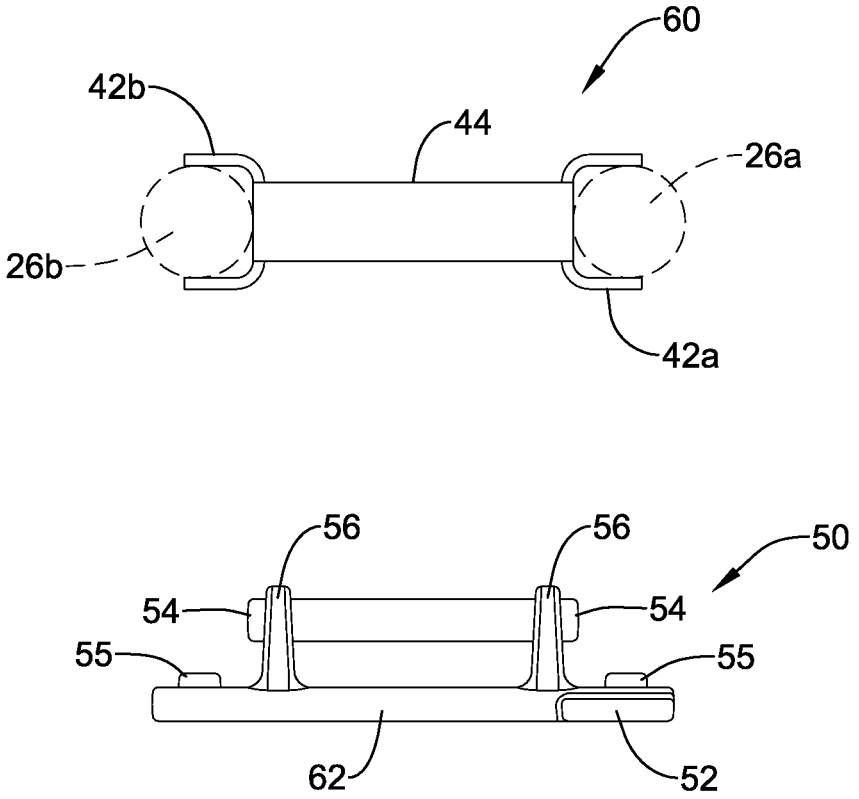
FIG. 7 is a top view of the components of the exemplary lead guide of FIGS. 5A and 5B.

The first end 64*a* of the brace 50 may include a first post 54 and a second post 55. As shown in FIG. 7, the first post 54 may extend generally perpendicular to the second post 55. The first post 54 may be configured to be inserted into a first opening 58 in the first guide rail 42*a*, while the second post 55 may be configured to be inserted into a second opening 59 in the first guide rail 42*a*. The first opening 58 may have a central longitudinal axis along which the first post 54 extends and the second opening 59 may have a central longitudinal axis along which the second post 55 extends. In some instances, the central longitudinal axis of the first opening 58 may be generally perpendicular to the central longitudinal axis of the second opening 59. In some embodiments, the first opening 58 may extend through a base portion of the first guide rail 42*a* and the second opening 59 may extend through a side portion of the first guide rail 42*a*.

Similarly, the second end 64*b* of the brace 50 may include a first post 54 and a second post 55. As shown in FIG. 7, the first post 54 may extend generally perpendicular to the second post 55. The first post 54 may be configured to be inserted into a first opening 58 in the second guide rail 42*b*, while the second post 55 may be configured to be inserted into a second opening 59 in the second guide rail 42*b*. The first opening 58 may have a central longitudinal axis along which the first post 54 extends and the second opening 59 may have a central longitudinal axis along which the second post 55 extends. In some instances, the central longitudinal axis of the first opening 58 may be generally perpendicular to the central longitudinal axis of the second opening 59. In some embodiments, the first opening 58 may extend through a base portion of the second guide rail 42*b* and the second opening 59 may extend through a side portion of the second guide rail 42*b*.

In some embodiments, the first post 54 at the first end 64*a* of the brace 50 may be co-axial with the first post 54 at the second end 64*b* of the brace 50, and/or the second post 55 at the first end 64*a* of the brace 50 may extend parallel to the second post 55 at the second end 64*b* of the brace 50.

The brace 50 may further include a first stop 56 positionable against the first guide rail 42*a* when the one or more posts 54, 55 at the first end 64*a* of the brace 50 are positioned in the one or more openings 58, 59 of the first guide rail 42*a*, and/or a second stop 56 positionable against the second guide rail 42*b* when the one or more posts 54, 55 at the second end 64*b* of the brace 50 are positioned in the one or more openings 58, 59 of the second guide rail 42*b*.

The stops 56 may be positioned between the first and second guide rails 42*a*, 42*b* to prevent movement of the guide rails 42*a*, 42*b* toward one another, while the engagement of the posts 55 in the openings 59 may prevent movement of the guide rails 42*a*, 42*b* away from one another. Thus, coupling the brace 50 to the bracket 60 may substantially stabilize the first and second guide rails 42*a*, 42*b* from movement relative to one another.

The lead guide 40 may also include a wear marker 52 configured to track or follow the movement of the brush 20. For example, the lead guide 40 may be arranged with the brush 20 such that the lead guide 40 moves with the brush 20 as the brush 20 travels in the brush holder 12 during the life of the brush 20. In other words, the lead guide 40 and the brush 20 are configured to move together as the brush 20 is worn during use. Accordingly, movement of the marker 52 may directly correspond to movement of the brush 20. For example, linear or longitudinal displacement of the marker 52 may be equivalent, or otherwise proportional, to the linear or longitudinal movement and/or diminution of the brush 20 as the brush 20 is worn. The marker 52 may include one or more, or a plurality of, indicia or markings, or the like, that may aid in determining the position of the marker 52, and thus the position of the brush 20, as described in U.S. Pat. App. Pub. No. 2008/0291273, herein incorporated by reference in its entirety. As shown in the illustrative embodiment, the marker 52 may be formed integrally with the brace 50 and extend from the cross member 62 of the brace 50. However, in other embodiments, the marker 52 may be a portion of the bracket 60, or the marker 52 may be formed separately and attached to the brace 50, the bracket 60, or another component of the lead guide 40, if desired.

Referring again to the assembled configuration of FIGS. 1 and 2, it can be seen that the guide 40 may be configured such that the connecting member 44 of the bracket 60 and the connecting member 62 of the brace 50 of the guide 40 extend through the coil spring 24 such that the coil of the spring 24 surrounds the connecting member 44 of the bracket 60 and the connecting member 62 of the brace 50, with the coil of the spring 24 positioned between the first and second leads 26*a*, 26*b*. Thus, when the guide 40 is assembled between the first and second leads 26*a*, 26*b* the coil of the spring 24 may pass under the cross member 62 of the brace 50 and between the cross member 62 of the brace 50 and the upper surface 21 of the brush 20, and the coil of the spring 24 may also pass over the cross member 44 of the bracket 60 and between the cross member 44 of the bracket 60 and the portions of the leads 26*a*, 26*b* extending from the guide 40 to the terminal 28.

In assembling the guide with the leads 26*a*, 26*b* of the brush 20, one of the guide rails 42 (either the first guide rail 42*a* or the second guide rail 42*b*) of the bracket 60 may be passed through the opening of the coil of the spring 24 such that the first guide rail 42*a* is positioned on a first side of the coil of the spring 24 and the second guide rail 42*b* is positioned on a second side of the coil of the spring 24. The first lead 26*a* may be positioned in the channel 46 of the first guide rail 42*a* and the second lead 26*b* may be positioned in the channel 46 of the second guide rail 42*b*. As shown in FIG. 7, the first guide rail 42*a* (including a base portion and opposing side portions) may surround the first lead 26*a* on three sides of the first lead 26*a* when the first lead 26*a* is positioned in the channel 46, and the second guide rail 42*b* (including a base portion and opposing side portions) may surround the second lead 26*b* on three sides of the second lead 26*b* when the second lead 26*b* is positioned in the channel 46.

The cross member 62 of the brace 50 may be passed through the opening of the coil of the spring 24, and the ends 64*a*, 64*b* of the brace 50 may be coupled to the respective guide rails 42*a*, 42*b*, as described above. For example, the posts 54 may be inserted into the openings 58 on opposite sides of the spring 24 with the stops 56 pressed against the first and second guide rails 42*a*, 42*b*, and the posts 55 may be inserted into the openings 59 on opposite sides of the spring 24. Engagement of the brace 50 between the guide rails 42*a*, 42*b* of the bracket 60 may stabilize the guide rails 42*a*, 42*b* from movement toward and/or away from one another.

The portions of the leads 26*a*, 26*b* extending from the guide 40 to or toward the terminal 28 may be brought toward one another such that the leads 26*a*, 26*b* converge above the lead guide 40. The portions of the leads 26*a*, 26*b* extending from the guide 40 may be secured together with a fastener 36, such as a clip, tape, ring, or other mechanism to hold the leads 26*a*, 26*b* together. Additional fasteners 36 may be used if desired along portions of the length of the leads 26*a*, 26*b* to secure the leads 26*a*, 26*b* in a desired arrangement. Accordingly, the fastener 36 may prevent the leads 26*a*, 26*b* from spreading apart, while the guide 40 may prevent the leads 26*a*, 26*b* from converging together, thus holding the leads 26*a*, 26*b* in a desired position.

The terminal 28 may be coupled to an electrically conductive member to complete an electrical connection from the brush 20.

Those skilled in the art will recognize that aspects of the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A lead guide for maintaining the leads extending from a brush of a brush holder assembly in a desired position, the lead guide comprising:

a bracket comprising a first guide rail, a second guide rail, and a cross member extending between the first guide rail and the second guide rail;

the first guide rail including a channel for receiving a first lead from the brush and the second guide rail including a channel for receiving a second lead from the brush, the bracket configured to space the first lead away from the second lead to permit a spring of the brush holder assembly to be positioned therebetween;

wherein the first lead extends from opposite ends of the channel of the first guide rail; and wherein the second lead extends from opposite ends of the channel of the second guide rail.

2. The lead guide of claim 1, wherein the channel of the first guide rail opens out in a first direction and the channel of the second guide rail opens out in a second direction, opposite the first direction.

3. The lead guide of claim 1, wherein the first guide rail extends generally parallel to the second guide rail.

4. The lead guide of claim 1, further comprising:

a brace configured to be attached to the bracket between the first guide rail and the second guide rail to stabilize the first guide rail relative to the second guide rail.

5. The lead guide of claim 4, wherein the cross member extends between a first end of the first guide rail and a first end of the second guide rail, and the brace extends between a second end of the first guide rail and a second end of the second guide rail.

6. The lead guide of claim 5, wherein the brace includes a wear marker extending from a bridge portion of the brace, the bridge portion extending between the second end of the first guide rail and the second end of the second guide rail.

7. The lead guide of claim 5, wherein the brace is configured to prevent movement of the second ends of the first and second guide rails toward one another.

8. The lead guide of claim 4, wherein the brace includes a first end having one or more posts configured to interlock with one or more openings in the first guide rail, and the brace includes a second end having one or more posts configured to interlock with one or more openings in the second guide rail.

9. The lead guide of claim 8, wherein the brace includes a first stop positionable against the first guide rail when the one or more posts at the first end of the brace are positioned in the one or more openings of the first guide rail, and a second stop positionable against the second guide rail when the one or more posts at the second end of the brace are positioned in the one or more openings of the second guide rail.

10. A brush holder assembly for an electrical device, the brush holder assembly comprising:

a brush holder;

a brush positionable in the brush holder, the brush including a first lead extending from the brush and a second lead extending from the brush; and a lead guide positionable between the first lead and the second lead, the lead guide comprising a bracket having a first guide rail, a second guide rail, and a cross member extending between the first guide rail and the second guide rail;

wherein the lead guide is configured to travel with the brush relative to the brush holder as the brush diminishes in length during use;

wherein the lead guide is configured to prevent the first lead and the second lead from contacting the brush holder and restricting free movement of the brush in the brush holder;

wherein the lead guide is removable from the brush while the first lead and the second lead remain secured to the brush.

11. The brush holder assembly of claim 10, wherein the first lead and the second lead extend from the brush at spaced apart locations, and wherein the lead guide is positionable between a base portion of the first lead and a base portion of the second lead.

12. The brush holder assembly of claim 11, wherein portions of the first and second leads extending from the lead guide converge and are fastened together.

13. The brush holder assembly of claim 11, wherein the first guide rail extends along the base portion of the first lead and the second guide rail extends along the base portion of the second lead.

14. The brush holder assembly of claim 13, further comprising:

a spring configured to exert a force against the brush in the brush holder, the spring positionable between the first guide rail of the lead guide and the second guide rail of the lead guide.

15. The brush holder assembly of claim 14, wherein the lead guide includes a brace extending between the first guide rail and the second guide rail to stabilize the first guide rail relative to the second guide rail.

16. The brush holder assembly of claim 15, wherein the brace extends through a coiled portion of the spring.

17. The brush holder assembly of claim 13, wherein the lead guide includes a brace extending between the first guide rail and the second guide rail to stabilize the first guide rail relative to the second guide rail.

18. The brush holder assembly of claim 17, wherein the brace is configured to prevent movement of the first and second guide rails toward one another.

19. The brush holder assembly of claim 18, wherein the brace includes a first end having one or more posts configured to interlock with one or more openings in the first guide rail, and the brace includes a second end having one or more posts configured to interlock with one or more openings in the second guide rail.

20. The brush holder assembly of claim 19, wherein the brace includes a first stop positionable against the first guide rail when the one or more posts at the first end of the brace are positioned in the one or more openings of the first guide rail, and a second stop positionable against the second guide rail when the one or more posts at the second end of the brace are positioned in the one or more openings of the second guide rail.

21. The brush holder assembly of claim 10, wherein the brush holder has an opening therethrough for receiving the brush, the opening having a width, wherein the lead guide maintains the first lead and the second lead in a position such that the first lead and the second lead are held within the width of the opening of the brush holder to ensure the first lead and the second lead do not interfere with movement of the brush within the brush holder during use of the brush holder assembly.

22. The brush holder assembly of claim 10, wherein the lead guide includes a brush wear indicator configured to follow movement of the brush to indicate the extent to which the brush has worn.

23. The brush holder assembly of claim 10, further comprising:

a spring configured to exert a force against the brush in the brush holder;

wherein the lead guide is positioned between the first and second leads and the spring to prevent the first and second leads from directly contacting the spring.

24. The brush holder assembly of claim 10, wherein the first guide rail includes a channel for receiving the first lead and the second guide rail includes a channel for receiving the second lead;

wherein the first lead extends from opposite ends of the channel of the first guide rail, and the second lead extends from opposite ends of the channel of the second guide rail.

25. A lead guide for maintaining the leads extending from a brush of a brush holder assembly in a desired position, the lead guide comprising:

a bracket comprising a first guide rail, a second guide rail, and a cross member extending between the first guide rail and the second guide rail;

the first guide rail including a channel for receiving a first lead from the brush and the second guide rail including a channel for receiving a second lead from the brush, the bracket configured to space the first lead away from the second lead to permit a spring of the brush holder assembly to be positioned therebetween;

wherein the channel of the first guide rail opens out in a first direction and the channel of the second guide rail opens out in a second direction, opposite the first direction.

26. A brush holder assembly for an electrical device, the brush holder assembly comprising:

a brush holder;

a brush positionable in the brush holder, the brush including at least one lead extending from an upper surface of the brush, such that the at least one lead extends through an upper opening of the brush holder;

a lead guide coupled to the at least one lead; and a spring including a coiled portion positioned over the upper surface of the brush when the brush is positioned in the brush holder, the spring being configured to exert a force against the brush in the brush holder;

wherein the lead guide is configured to travel with the brush relative to the brush holder as the brush diminishes in length during use;

wherein the lead guide is configured to prevent the at least one lead from contacting the brush holder and restricting free movement of the brush in the brush holder;

wherein the lead guide is positioned between the at least one lead and the coiled portion of the spring to prevent the at least one lead from directly contacting the coiled portion of the spring.

* * * * *